US008779997B2

(12) United States Patent
Harris

(10) Patent No.: US 8,779,997 B2
(45) Date of Patent: Jul. 15, 2014

(54) APPARATUS AND METHOD FOR A VARIABLE-RATIO ROTATIONALLY POLARIZED SLOT-STYLE TELEVISION AND RADIO BROADCAST ANTENNA

(75) Inventor: George Harris, Auburn, ME (US)

(73) Assignee: Micronetixx Technologies, LLC, Lewiston, ME (US)

( * ) Notice: Subject to any disclaimer, the term of this patent is extended or adjusted under 35 U.S.C. 154(b) by 237 days.

(21) Appl. No.: 13/474,530

(22) Filed: May 17, 2012

(65) Prior Publication Data

US 2013/0127679 A1 May 23, 2013

Related U.S. Application Data

(60) Provisional application No. 61/486,899, filed on May 17, 2011.

(51) Int. Cl.
*H01Q 19/00* (2006.01)
*H01Q 13/10* (2006.01)

(52) U.S. Cl.
USPC ..... 343/756; 343/791; 343/770

(58) Field of Classification Search
CPC .... H01Q 15/246; H01Q 13/12; H01Q 13/203
USPC ..... 343/756, 790, 791, 770
See application file for complete search history.

(56) References Cited

U.S. PATENT DOCUMENTS

| | | | | |
|---|---|---|---|---|
| 4,297,706 | A * | 10/1981 | Nikolayuk | 343/771 |
| 4,583,098 | A * | 4/1986 | Sikina, Jr. | 343/771 |
| 4,590,480 | A * | 5/1986 | Nikolayuk et al. | 343/771 |
| 6,784,848 | B2 * | 8/2004 | Harris | 343/791 |
| 7,205,952 | B2 * | 4/2007 | Harris | 343/791 |

* cited by examiner

*Primary Examiner* — Hoang V Nguyen
(74) *Attorney, Agent, or Firm* — Robert L. Shaver; Dykas & Shaver, LLP

(57) ABSTRACT

Disclosed is a microwave or radio wave broadcast antenna array constructed to produce rotating fields of energy for broadcast or transmission. The array has an inner conductor enclosed within a tubular outer conductor, and is connected to an energy source. The outer conductor has slots in the wall of the conductor, and rotational polarizers are positioned on either side of the slots to induce rotation and polarization of the transmitted energy.

10 Claims, 6 Drawing Sheets

APPARATUS AND METHOD FOR A VARIABLE-RATIO ROTATIONALLY POLARIZED SLOT-STYLE TELEVISION AND RADIO BROADCAST ANTENNA

TECHNICAL FIELD

The disclosed technology relates to signal broadcast antennas, and more particularly to slot style radio Television and microwave broadcast antennas.

BACKGROUND

When commercial broadcast television and radio stations were first being built, a means of implementing a reliable, high power broadcast transmitting antenna was required. There were many antenna designs that were put forward during that time. Included in these many designs, (most of which emerged in the 1950's and 1960's), was a Transverse Electromagnetic Mode, (TEM), coaxial slot-style collinear antenna design. This highly-reliable design is rugged and extremely power tolerant. It is coaxial, meaning that it consists of two metallic conductors with different diameters. The larger conductor is hollow so that the smaller conductor can be placed inside of the outer one. The conductors are arranged vertically and vertically-oriented slots are cut or machined, longitudinally through the wall of the outer conductor. Usually, these slots are at least one-half of a free-space wavelength long, and are placed longitudinally at specific intervals along the length of the outer cylindrical conductor, such that the relative magnitudes and phases of the electromagnetic waves from each individual radiating structure along the array will form the desired far-field characteristics, such as pattern and elevation array gain.

Since this coaxial assembly forms a TEM-Mode coaxial transmission line, TEM-Mode electromagnetic fields from the transmitter connected to the inner and outer conductors of the antenna, alternate at the channel frequency and are set up in the space between the outside surface of the inner conductor, (the conductor that is placed inside of the outer conductor pipe, tube or cylinder), and the inside surface of the outer conductor. A structure called a coupler provides a means of coupling to the electric and/or magnetic TEM-Mode fields inside of the coaxial pylon antenna array. This coupler is electrically connected to one side of each slot in the array, and will impress a voltage or electric potential difference across the slot opening. Since the slots represent the absence of a conductor, and if the coaxial pipe is oriented vertically, (with the slots also oriented vertically), the alternating voltage across each slot will give rise to an electric field, whose direction points horizontally from one longitudinal slot edge to the other. The magnitude of the electric field will depend on how strongly the coupling structures at each slot couple to the TEM-Mode system of fields inside of the coaxial pylon. Again, if the coaxial pylon and hence, the slots are oriented vertically, then the voltage giving rise to the electric fields across the slots will be oriented horizontally. This oscillating horizontal electric field from each of the slots in the array will add together in the far-field, (depending on the relative magnitudes and phases from each of the slots, or electromagnetic radiating centers in the array), forming a horizontally-polarized, propagating electromagnetic wave.

If these radiating slots in a vertically-oriented cylindrical outer conductor are analyzed, it is seen that the same coupling structures that excite a voltage across the slots cut in the conducting cylinder or pipe will excite horizontal currents that will "loop" around the outer pipe's outer circumferential surface. These slot-voltage induced horizontally-oriented circumferential currents will then give rise to oscillating magnetic fields, who's North-South and then South-North direction is positioned vertically. Maxwell's Equations describe that this vertically-oriented oscillating magnetic field will give rise to an oscillating electric field, whose orientation is horizontal, (just as seen from the electric fields across the slots in the array). This is an example of a horizontally-polarized, slotted pylon antenna.

The radiation moments excited by the slot-excited circumferential currents that originate and terminate at each of the two longitudinal edges of the slots will exhibit radiation resistance that varies over frequency according to a number of factors, including the channel or radio frequency, pylon diameter, (hence, electrical length of the circumferential current path around the cylinder), the number of slots per level along the length of the pylon as well as other factors. This will greatly affect the reflected power, (or V.S.W.R.), at the input terminals of the coaxial pylon, as well as the V.S.W.R. frequency bandwidth, as well as the azimuth and elevation far-field electromagnetic radiation pattern frequency sensitivity.

SUMMARY OF THE DISCLOSURE

The disclosed technology is an improvement to prior art coaxial slot-style collinear antennas. It involves the addition of two perpendicular conducting members, called rotational polarizer's, one on each side of each slot. These are attached in pairs, one to each of the two edges of each of the slots in the array, each being placed at or near the longitudinal slot centers. The rotational polarizer's perform two major functions:

First, they provide a means of adding an adjustable capacitance in shunt with each of the slot networks in the array. The displacement current that flows between the two structures of the disclosed technology provides a means of adjusting the ratio between the displacement current between the two rotational polarizer's and the circumferential currents flowing on the outside surface of the outer conductor of the pylon antenna, allowing a maximization of the pattern and V.S.W.R. bandwidth.

Second, the rotational polarizer's can be fitted with vertical conductors, whose orientation is in parallel with the vertically-oriented slots. In addition to radiating a uniform horizontally-polarized propagating electromagnetic wave, the slots in the array also act as a balanced-to-unbalanced transformer, (balun), driving the vertically-oriented, and hence, vertically-polarized rotational polarizer's. These vertically-oriented conductors are voltage-driven by the voltage developed across the slots from the coupling structures, coupling to the TEM-Mode fields in the coaxial pylon antenna array. The length and tune condition of both the horizontal slots in conjunction with the length and physical position of the two rotational polarizer's circumferentially, (relative to the edges of the slots in the array), are mutually-adjusted for the desired axial ratio, (either circularly- or elliptically-polarized), of the rotationally-polarized propagating electromagnetic wave. The "sense" of the rotationally-polarized wave, (either "right-hand" or "left-hand"), is determined by the direction of the Rotational polarizer; oriented either upward on the left side of the slot as the slot is viewed straight-on, or pointing downward on the right side of the slot, as the slot is viewed straight-on. (If the rotational polarizer on the left side of the slot is pointed upward, then the rotational polarizer on the right side of the slot will be oriented downward, and vise versa.)

Finally, the disclosed technology can be used to adjust the tuning and/or coupling of the electromagnetic radiating structures in the array in any polarization implementation, (linear, elliptical or circular), to optimize all aspects of the pylon antenna, including the Insertion V.S.W.R., V.S.W.R. bandwidth, axial ratio, azimuth and elevation radiation patterns.

PREFERRED EMBODIMENT

Figure 1:
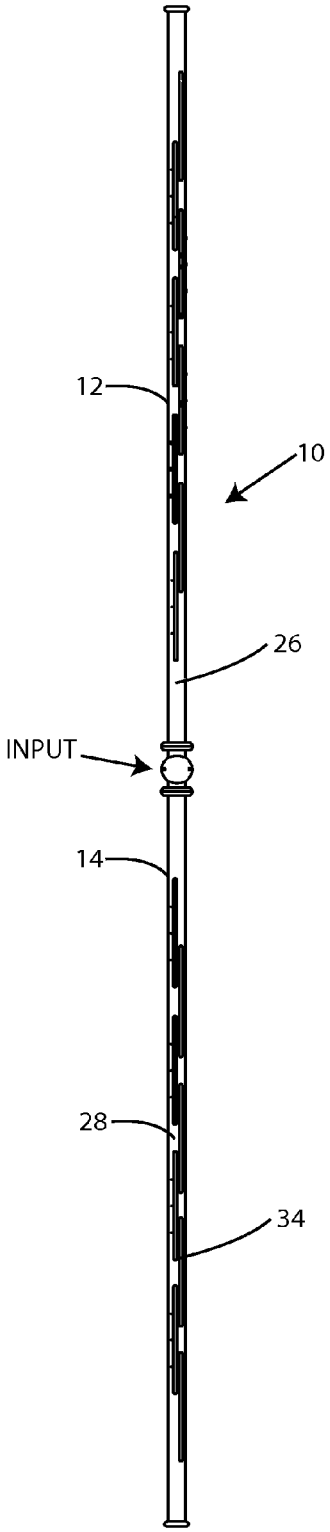
FIG. 1 is a front view of the disclosed coaxial antenna array.

Shown in the figures is a pylon array with an upper arm and a lower arm, each made up of an inner conductor inside a hollow outer conductor. The hollow conductors have slots in the material of the outer conductor. The device disclosed is an antenna for transmitting radio, Television or microwave signals, for communication and broadcasting, and for short and long distance. This antenna is connected to an energy source, such as a Television and/or Radio Transmitter or microwave source. The antenna can be mounted and connected to any supporting structure such as a building or a pole. A coaxial TEM-Mode transmission line connects the antenna to the energy source. This transmission line brings the signal from the microwave generator up to the antenna. The antenna includes two rotational polarizer's associated with each slot, also called variable-ratio rotationally-polarized radiating and tuning structures. The rotational polarizer's are or can be vertical oriented conductors.

In the coaxial pylon structures, the inner conductor is insulated from the external conductor. The internal pipe is quite a bit smaller, in a ratio of approximately 2.28 to 1. Other diametric ratios can also be used, depending on the desired surge impedance of the antenna. The inside diameter of the outer conductor in this example with a surge impedance of approximately 50 Ohms is approximately 2.28 as large as the outside diameter of the inner conductor. The two conductors are basically a pipe inside a pipe.

The outer conductor has slots, and each slot is fitted with a coupling structure inside that can take the form of either electric, magnetic or electro-magnetic coupling structure. The signals in every one of these slots are designed to add constructively in phase and reinforcing each other relative to where the antenna is. What the rotational polarizer's do is spin the electric field in a corkscrew fashion, as the system of radiated fields propagates away from the antenna. They cause rotational-polarization by the slots by actually electrically driving the rotational polarizer's and the interaction from the electric field radiated from the slot with the radiated field from the slot and the electric radiated field and the radiated field from the rotational polarizer result in a rotationally polarized system of propagating electromagnetic fields, radiating from the structure.

As the energy leaves the slot it interacts with the rotational polarizer's and induces spin. The slot acts as a balun, which means balanced to unbalanced, which electrically drives the rotational polarizer's. The result is an electric field that spins like a propeller, as the system of fields propagates away from the antenna. The rotational polarizer's are stationary, and the energy fields are moving, and interact with the rotational polarizer's to have spin induced. A horizontal electric field comes from the slot and vertical electric field come from the rotational polarizer section, which is delayed in phase, by an amount that is adjusted according to the Polarizer length, relative to the slot fields. They add together and cause a spinning of the electromagnetic system of radiating fields, as they propagate away from the antenna.

Shown in FIG. 1 is an example of the disclosed Variable Ratio Rotational Polarized Antenna 10. It is made up of an upper pylon 26, and a lower pylon 28. The upper pylon 26 is made up of an upper outer conductor 12 and an upper inner conductor 16 (not visible in this view). The lower pylon 28 is made up of a lower outer conductor 14. The outer conductors 12 and 14 surround the inner conductors 16 and 18, and do not touch. In one example of a system of the disclosed technology, the upper outer conductor 12 would be 209 in. long and capped at the end. The lower outer conductor would be the same length. The outer conductors 12 and 14 are sized in relation to the inner conductor 2.28 to 1. Thus if the inner diameter of the outer conductors is 2.28 inches, the outer diameter of the inner conductor would be 1 inch. The inner and outer conductors are made of aluminum, steel, stainless steel, copper or other conductive material.

Figure 2:
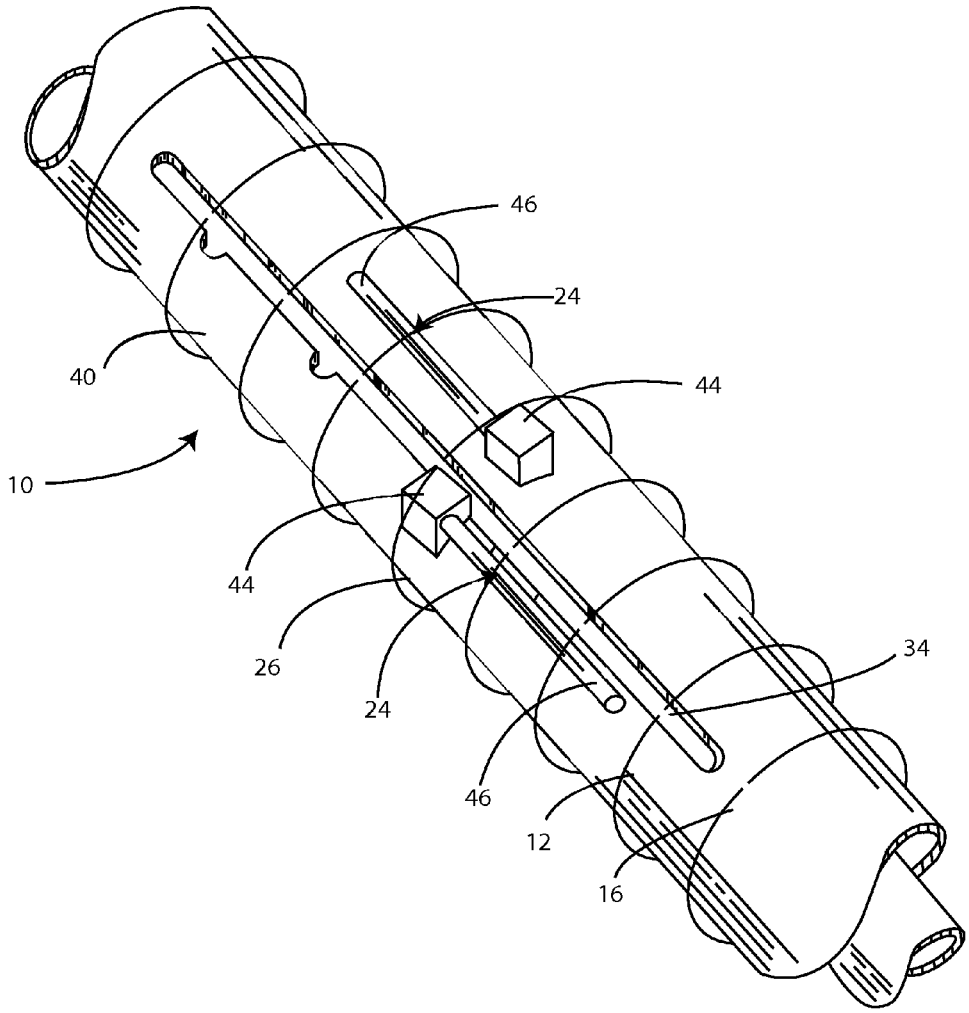
FIG. 2 is a perspective view of the disclosed coaxial antenna array, showing a slot and rotational polarizers.

Shown in FIG. 2 is a section of the pylon 26 showing one slot 34 in the outer conductor 12, with the inner conductor 16 being visible. The rotational polarizer's 24 have a mount 44 and an electrode 46. The electrodes 46 are generally solid but can be either solid or hollow. The rotational polarizer's 24 dimensions can vary according to the physical size of the overall antenna and its operating frequency. Usually they are between less than 0.1 wave lengths at the operating frequency to over one quarter wave lengths at the operating frequency. The rotational polarizer's 24 can be made of aluminum, steel, stainless steel or any electrically conducting material. The rotational polarizer's 24 are generally round in cross-section, but can be square, rectangular, or a strip of electrically conducting material. They are physically mounted on standoff mounts 44, spaced between 0.05 wave lengths or less at the center operating frequency up to 0.15 or more wave lengths at the center operating frequency off, up from the outside surface of the outer cylinder, just adjacent to the slots as shown in the Figure. They are usually, but not always, depending on the tuning requirements of the antenna, positioned longitudinally at the slot center.

The length and width of the rotational polarizer's is determined by electrical testing at this time of manufacture. In an example system of the disclosed technology, the outer conductor would be approximately 100 millimeters in outside diameter, made of aluminum or steel, with the wall thickness of approximately one quarter of an inch, an inner diameter of approximately 31 millimeters (that doesn't make sense if the OD is 100, and wall thickness is 6.36 mm), and between 1 and up to 25 or more wave lengths long at the center operating frequency of the apparatus. Thus for an example system using wave lengths of 10, with a free-space wavelength of 19 inches, the outer conductor would be approximately 11 free-space wavelengths long, or about 209 inches, to 215 long. The length and width of the Slots is determined by the electrical requirements of the application.

The inner conductor could be, in the above example, using a 100 millimeter outer conductor diameter with one quarter inch (6.35 millimeter) wall thickness and 38.29 millimeters inner conductor outside diameter, usually made of copper or aluminum but can be made of any electrically conducting material. The wall thickness of the inner conductor could typically be less than 0.7 millimeters up to a solid rod. The outside diameter of the inner conductor is approximately 38.29 millimeters in this example, with the length being between one electrical wave lengths long at the center operating frequency of the apparatus and up to 25 or more electrical wave lengths long at the center operating frequency of the apparatus. Length and width is determined by the characteristic surge impedance requirement of the system that the apparatus is operating with. In this example, the 2.28:1 outside diameter of the inner conductor to inside diameter of the outer conductor ratio, the Surge Impedance of the antenna resulting from this 1:2.28 ratio is approximately 50 ohms.

The slot would be approximately 0.025 electrical wave lengths at the center operating frequency wide, and approximately 0.8 electrical wave lengths at the center operating frequency long. Thus, for a system using a 19 inch, (482.6 mm), free-space wave length, and the slots would be approximately 386 mm long and 12.07 mm wide. The side notches along the edges of the slot are for mounting the coupling structures to the inside diameter of the outer conductor, just adjacent to the slots, and for mechanical and electrical adjustment of the relative mechanical position of the coupling structure inside the outer cylinder, for tuning and coupling purposes, in the space between the inner conductor and the outer conductor. The coupling structures are fastened to the inside wall of the outer conductor, just adjacent to the slots using standard fasteners, such as screws, nuts, studs and bolts, through the small slots provided for the fasteners, perpendicular to the long longitudinal radiating slots in the outer conductor of the antenna.

The antenna is of a variable ratio, because the rotational polarizer size and many other adjustable factors including the slot width, the slot length, the relative coupler positioning, the height of the rotational polarizer's on their standoff mounts on the outside of the pylon, as well as their length relative to an electrical wave length at the center opening frequency of the apparatus can all be adjusted.

Figure 3:
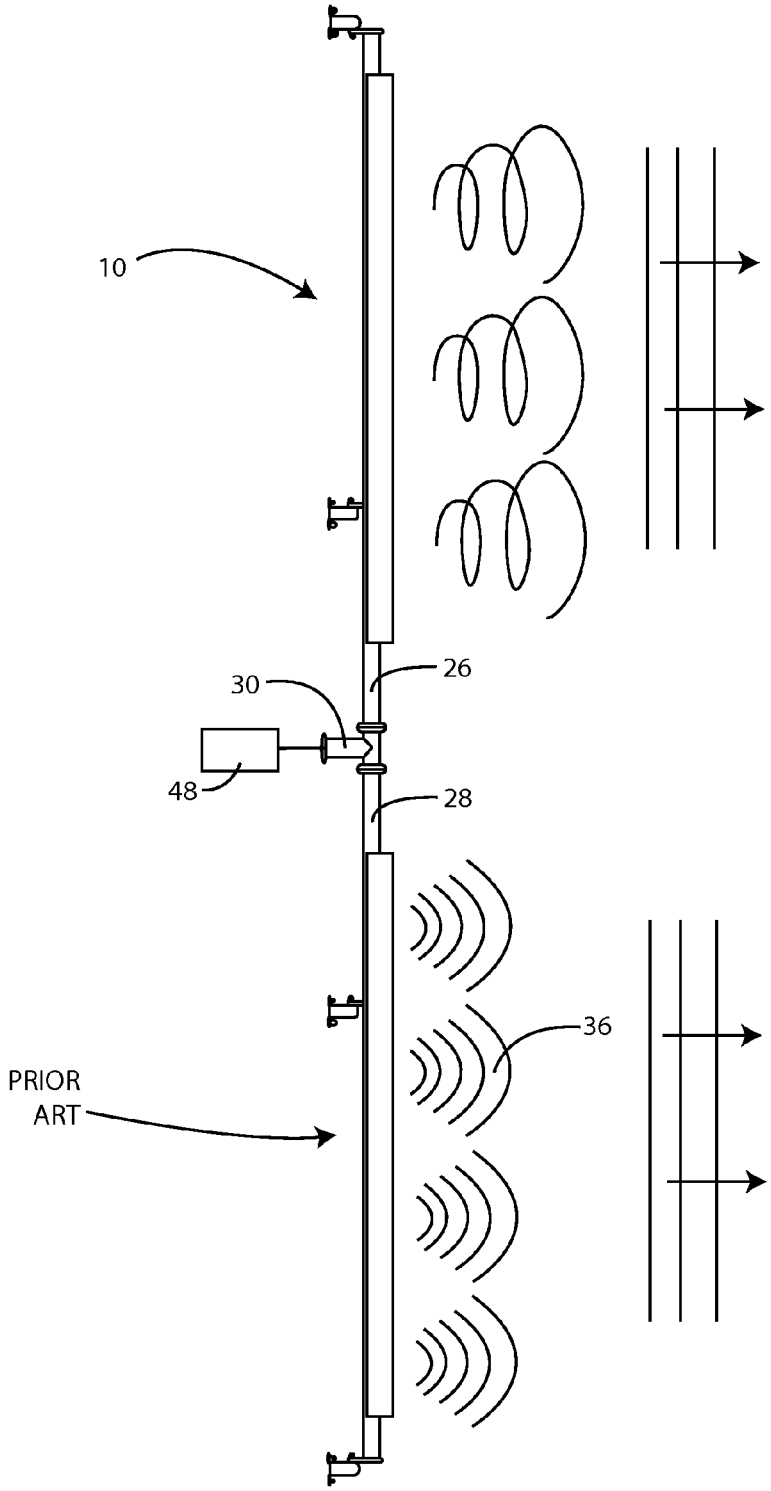
FIG. 3 is a side view of the disclosed coaxial antenna array, with the lower pylon showing prior art energy generation.

FIG. 3 is a side view of the antenna showing the input T 30 which joins the pylons 26 and 28 to the power source 48. Shown are the rotating energy fields from the slots of upper pylon 26, which join to form a unified energy wave. The energy fields of lower pylon 28 show what the TEM fields would look like from a prior art antenna without polarizer's. Shown is a cover 50 called a Radome. It is usually made of an ultra-violet-stabilized polyethylene, teflon or other material that is essentially transparent to the radio signals being transmitted by the Apparatus. The advantage of the rotationally polarized energy fields is that the signals will propagate to their destinations and will excite a received signal in the receiving antenna, independent of the receiving antenna's polarization. Also, any propagating electromagnetic wave that is not rotationally-polarized, (linearly-polarized), can be subjected to Faraday Rotation be electric and/or magnetic fields that are present in the regions that the propagating electromagnetic fields are traveling through, such as the Earth's magnetic field, or magnetic field moments from naturally-occurring and/or man-made magnetized materials interacting the propagating electromagnetic wave. If the receiving antenna is not rotationally-polarized, as is often the case, then if a propagating electromagnetic wave interacts with the intended receive antenna, whose polarization is not aligned with the incident propagating electromagnetic wave, then unwanted signal reduction or drop-out can result.

Figure 4:
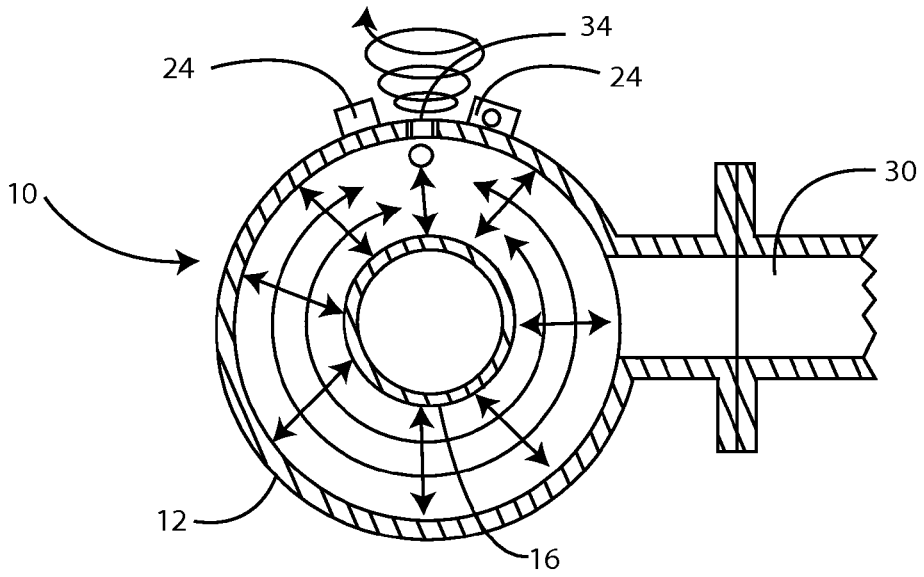
FIG. 4 is a cross sectional view of a pylon of the disclosed coaxial antenna array.

FIG. 4 shows a cross section of a pylon, with the coupler 20 and rotational polarizer's, and the Input T from the source. Shown is inner conductor 16 and outer conductor 12. Shown are horizontal circumferential currents 38, and oscillating magnetic fields 42.

Figure 5:
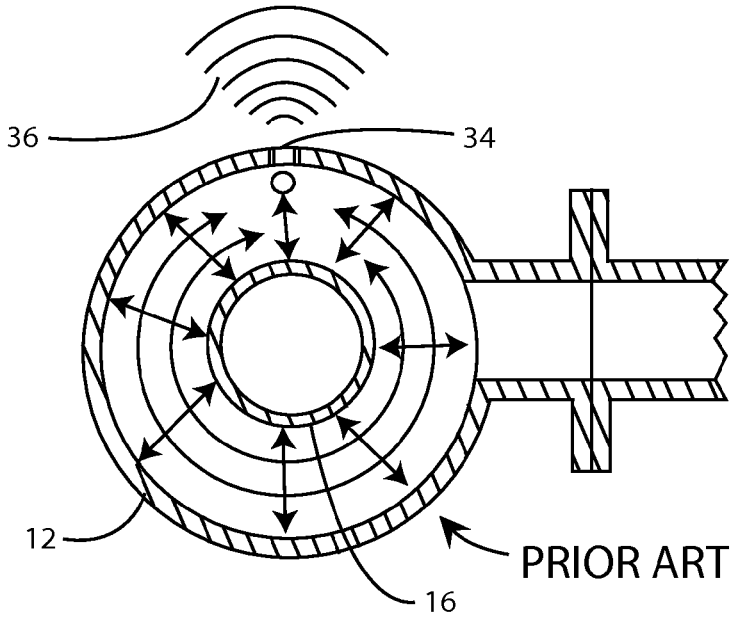
FIG. 5 is a cross sectional view of a pylon of a prior art slot antenna.

FIG. 5 shows the antenna with slots, but without rotational polarizer's, showing the antenna producing TEM mode energy fields 36.

Figure 6:
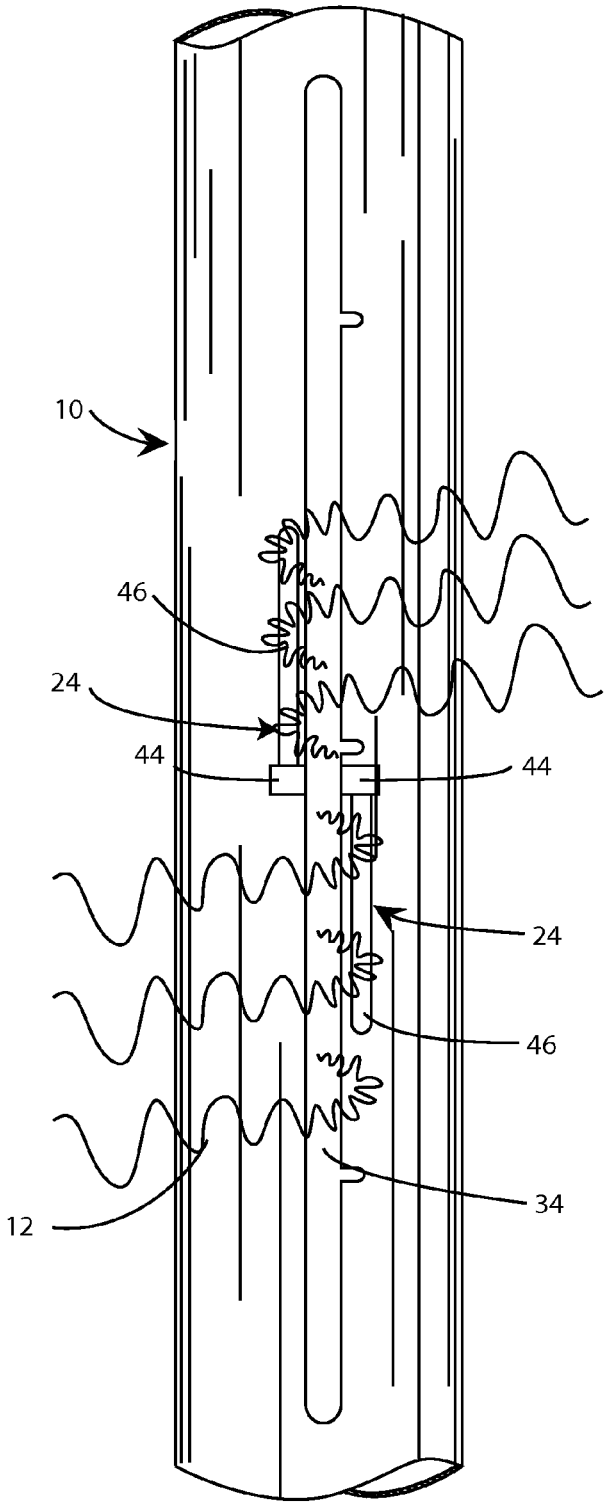
FIG. 6 is a front view of a slot and rotational polarizers of the disclosed coaxial antenna array.

Shown in FIG. 6 is a slot 34 in an outer conductor with rotational polarizer's 24 having mounts 44 and electrodes 46. Shown are horizontally oriented circumferential currents 40 interacting with the electrodes 46.

Figure 7:
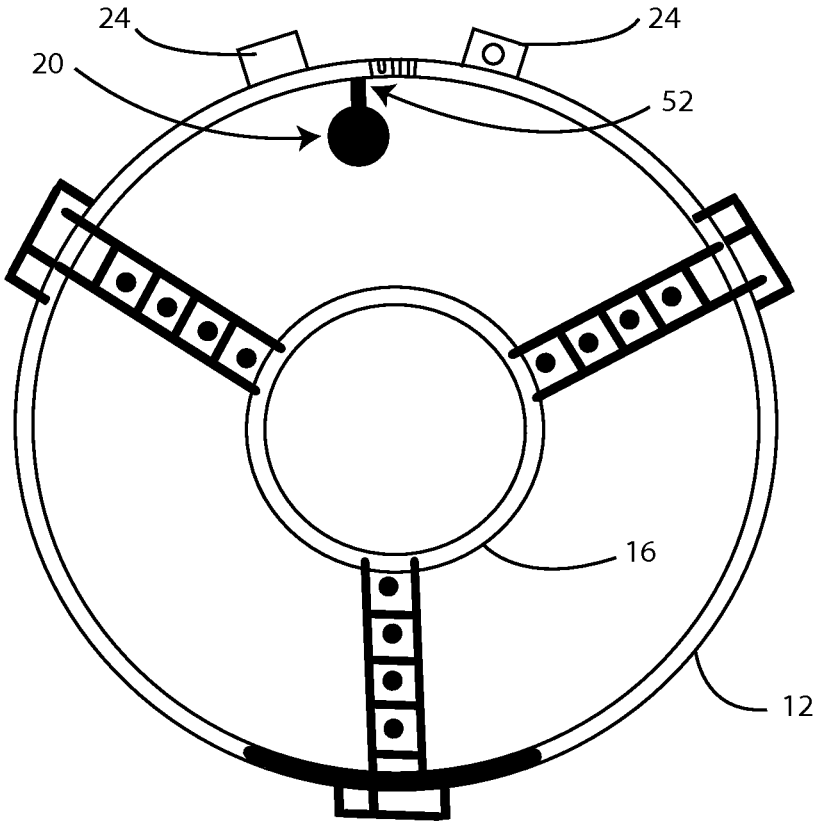
FIG. 7 is a cross sectional view of a pylon showing a coupler and spacing structures.

Shown in FIG. 7 is a cross section of the inner and outer conductors showing the coupler 20, with an adjustment screw 52. The inner conductor 16 is spaced from the outer conductor 12 using centering structures 54, which are invisible to microwaves or RF, and can be made of Teflon, ceramic, or plastic. These placed about every 1.5 to 2 meters inside the pylon array. the coupler is attached via adjustable screws or threaded studs to the Inside Surface of the outer cylinder, just adjacent to the slots, as shown. It is attached to nothing else. (There can be either one or two threaded fasteners securing the Coupling Structure, depending on the Coupling Structure's size and shape.) The size and shape of the Coupling Structure is determined at electrical test for proper tuning and antenna performance.

The Coupling Structure couples to the electric and/or magnetic fields in the region of the antenna between the inside surface of the outer conductor and the outside surface of the inner conductor.

The Coupling Structure is mechanically adjusted for optimum electrical characteristics, including signal reflection minimization at the antenna's input terminals, relative uniformity of the radiated signal characteristics, including relative signal magnitude and phase.

I claim:

1. A coaxial pylon antenna array, comprising;

an input connection for connecting to a source of electromagnetic energy;

a pylon section attached to said input connection, comprising an inner conductor surrounded by a tubular outer conductor, each with a longitudinal axis;

with said outer conductor defining a plurality of slots parallel with the longitudinal axis and along one side of said outer conductor;

a pair of rotational polarizers attached to an outer surface of said outer conductors adjacent to each slot and attached on opposite sides of said slot, with each of said rotational polarizers comprised of a mounting block or other electrically-conductive support attached to said outer conductor adjacent an edge of each of said slots, and said rotational polarizers further comprising a cylindrical or circular, square or rectangular cross-section conductor which extends from said mounting block or other electrically-conductive support, parallel with said slot edge, and spaced apart from said surface of said outer conductor, along an edge of each of said slots, with said polarizers configured to cause polarization and rotation of energy waves exiting said slot.

2. The coaxial pylon antenna array of claim 1 which further comprises an upper and lower pylon, joined with an input T usually between the upper and lower sections which is connected to said source of electromagnetic energy.

3. The coaxial pylon antenna array of claim 1 which further comprises a single section with an input at one end of the pylon, which is connected to said source of electromagnetic energy.

4. The coaxial pylon antenna array of claim 2 in which said upper and lower pylons are oriented in a vertical position.

5. The coaxial pylon antenna array of claim 3 in which said pylon is oriented in a vertical position.

6. The coaxial pylon antenna array of claim 1 in which said slots are formed in a line along one or several sides of said outer conductor.

7. The coaxial pylon antenna array of claim 1 in which said slots are formed in two adjacent lines on one or several sides of said outer conductor, and parallel with said long axis of said outer conductor.

8. A coaxial pylon antenna array, comprising;

an input T connection for a center-fed antenna or single connection at one end of a single section pylon antenna for connecting to a source of electromagnetic energy;

an upper and lower pylon section attached to said input T connection or a single end-fed section and oriented vertically, each pylon comprising an inner conductor surrounded by a tubular outer conductor, each with a longitudinal axis;

with each of said outer conductors defining a plurality of slots parallel with the longitudinal axis along one side of said outer conductor;

a pair of rotational polarizers attached to an outer surface of each of said outer conductors adjacent to each slot and attached on opposite sides of each slot, with each of said rotational polarizers comprised of a mounting block attached to said outer conductor adjacent an edge of each of said slots, and said rotational polarizers further comprising a cylindrical conductor which extends from said mounting block parallel with said slot edge, and spaced apart from said surface of said outer conductor, along an edge of each of said slots, with said polarizers configured to cause polarization and rotation of energy waves exiting said slot.

9. The coaxial pylon antenna array of claim 7 in which said slots are formed in a line along one side of said outer conductor.

10. The coaxial pylon antenna array of claim 7 in which said slots are formed in two adjacent lines on one side of said outer conductor, and parallel with said long axis of said outer conductor.

* * * * *